US007099489B2

(12) United States Patent
Pan et al.

(10) Patent No.: US 7,099,489 B2
(45) Date of Patent: Aug. 29, 2006

(54) TWIN MAGNETIC LOOP MULTIFUNCTIONAL VIBRATOR-SPEAKER TRANSDUCER

(75) Inventors: Zheng Min Pan, La Verne, CA (US); Jiazheng Sha, La Verne, CA (US); Pan Da Sheng, Shenzhen (CN); Le Ping Dong, Shenzhen (CN)

(73) Assignee: American Audio Components Inc., La Verne, CA (US)

( * ) Notice: Subject to any disclaimer, the term of this patent is extended or adjusted under 35 U.S.C. 154(b) by 203 days.

(21) Appl. No.: 10/820,665

(22) Filed: Apr. 7, 2004

(65) Prior Publication Data

US 2004/0208338 A1 Oct. 21, 2004

(30) Foreign Application Priority Data

Apr. 15, 2003 (CN) ..... 03 2 25308

(51) Int. Cl.
*H04R 1/00* (2006.01)
*H04R 25/00* (2006.01)

(52) U.S. Cl. ..... 381/423; 381/182; 381/401; 381/421

(58) Field of Classification Search ..... 381/150, 381/172, 182, 190, 191, 342, 386, 396, 400, 381/401, 402, 406, 412, 427, 421; 379/52; 340/388.1, 388.2, 407.1; 455/550, 567, 569, 455/575

See application file for complete search history.

(56) References Cited

U.S. PATENT DOCUMENTS

| | | | | |
|---|---|---|---|---|
| 6,608,541 | B1 * | 8/2003 | Shiraki et al. | 381/401 |
| 6,754,363 | B1 * | 6/2004 | Chang | 381/401 |
| 2002/0076068 | A1 * | 6/2002 | Chung | 381/150 |
| 2002/0164040 | A1 * | 11/2002 | Yang | 381/150 |

* cited by examiner

*Primary Examiner*—Sinh Tran
*Assistant Examiner*—Brian Ensey
(74) *Attorney, Agent, or Firm*—East IP Group; Philip K. Yu

(57) ABSTRACT

The present invention relates to a multifunctional device, which is particularly applicable to a twin magnet loop (called TML) transducer with both vibrating and sound functions. The present invention integrates an inner and an outer magnet loop of TML into one device, which can be used as a vibrator and a speaker. A disc-shaped pole core, a flange bowl-shaped magnetic transfer, an annular pole piece, a cylindrical magnet and an annular magnet constitute the inner and outer magnetic loops; wherein the disc-shaped pole core is placed on the cylindrical magnet and centered with the flange bowl-shaped magnetic transfer; the annular magnet and the annular pole piece are overlaid together under the ring of the flange bowl-shaped magnetic transfer; the entire of the TML assembly is connected with a housing base via a resilient plate. Comparing with the existing technology, the present invention has the advantages of that it integrates the inner and the outer magnetic loop of TML into one multifunctional device and makes the device more compact and more efficiency.

8 Claims, 2 Drawing Sheets

TWIN MAGNETIC LOOP MULTIFUNCTIONAL VIBRATOR-SPEAKER TRANSDUCER

FIELD OF TECHNOLOGY

The present invention relates to a multifunctional vibrator-speaker transducer, and more particularly, to a multifunctional vibrator-speaker transducer with twin magnetic loop ("TML") structure.

BACKGROUND OF TECHNOLOGY

The incoming call display of a mobile communication terminal, such as a cell phone, usually presents in two forms: sound and/or vibration. In current technology, these two functions are realized by a ringer and vibrating motor respectively. With the developments in communication technology and constant renewal in consumers' desires, cell phones have been gradually growing in functions and shrinking in size. That trend requires fewer components and parts to be compact in size. By using TML structure, a single device, which integrates the vibrating and sound function, can reduce the number of components and save valuable space in cell phones.

SUMMARY OF THE INVENTION

When performing electro-acoustic conversion function, the said multifunctional device follows the same principle as dynamic acoustic products: the coil carrying a signal current in a constant magnetic field drives vibrating diaphragm to produce sound. However, when performing electro-vibration conversion function, the said multifunctional device does not follow the same principle as vibrating motor: when passing through the vibrating coil, the electrical signal produces alternating magnetic field, which interacts with the constant magnetic field generated by the TML assembly. Sequentially, since the vibrating coil is connected with the rigid sheet, the whole TML assembly vibrates the entire device by conveying the vibration to the housing via the resilient plate to achieve the purpose of prompting. In order to ensure the vibrating swing is strong enough, it is preferable to adjust the stiffness coefficient of the resilient plate and the overall mass of the TML assembly to keep the inherent frequency of the vibrating system at a preset value between 100 Hz~200 Hz.

The objective of the present invention is achieved via the following technical solutions: The transducer in the present invention is integrated with inner and outer twin magnetic loops, and has vibrating and sound functions. The said transducer comprises a disc-shaped pole core, a flange bowl-shaped magnetic transfer, an annular pole piece, an inner and outer magnetic loops composed of a cylindrical and an annular magnets, wherein the pole piece is placed on the cylindrical magnet and centered with the flange bowl-shaped magnetic transfer; the annular magnet and the annular pole piece are overlaid together under the outer ring of the flange bowl-shaped magnetic transfer.

The disc-shaped pole core, the flange bowl-shaped magnetic transfer, the annular pole piece, the annular and the cylindrical magnet in the present invention are connected with the housing supporting base via a resilient plate so that either of the inner and outer loops can be used to produce sound, then the other can be used to provide driving magnetic field for the vibrating function of the device. A vibrating coil is inserted in the air gap, or spacing, of the said magnetic loop for vibrating functions; a rigid sheet is connected with the vibrating coil and integrated with the supporting housing. The said diaphragm used to produce sound may be polyester film, Perm alloy plate or voice diaphragms of other materials.

The inherent resonant frequency of the said unit, composed of the magnets, the voice coil and the vibrating diaphragm for accomplishing sound function, is preset a value above 400 HZ. The vibrating coil for performing vibrating function, the magnet, the resilient plate and the components of the entire TML form the vibrating system, of which the inherent resonant frequency is between 100–200 HZ.

The two magnets that form the TML may be elliptic columns and elliptic rings in shape; then the magnetic intervals between them are elliptic rings in shape; and correspondingly, all the components in the device, including the voice coil, the vibrating coil, the pole core, the magnetic transfer, the annular pole piece and the resilient plate are elliptic in shape too.

The present invention surpasses the existing technology by integrating an inner and an outer magnetic loop into one device and thus providing both vibrating and sound functions.

DESCRIPTION OF ENCLOSED DRAWINGS

PREFERRED EMBODIMENTS

Figure 1:
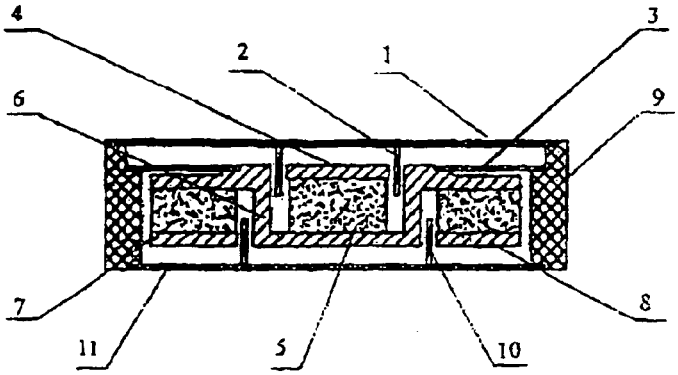
FIG. 1 is the sectional drawing of the configuration of the present invention.
Figure 2:
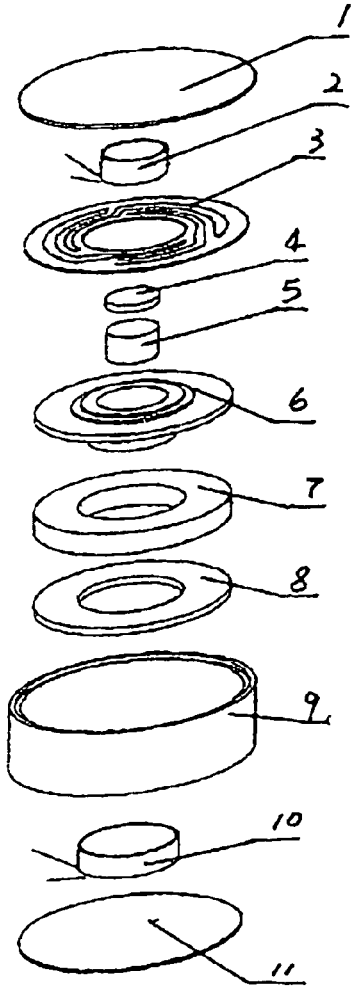
FIG. 2 is the breakdown drawings of components of the present invention.
Figure 3:
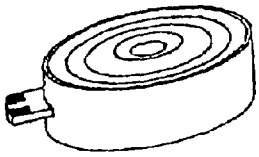
FIG. 3 is the outside drawing of the circular configuration of the present invention.
Figure 4:
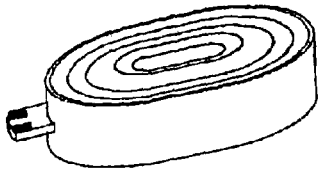
FIG. 4 is the outside drawing of the elliptic configuration of the present invention.
Figure 5:
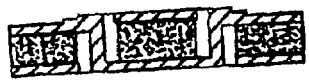
FIG. 5 is the schematic drawing of the configuration of the circular twin magnetic loops.
Figure 6:
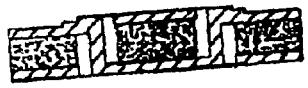
FIG. 6 is the schematic drawing of the configuration of the elliptic twin magnetic loops.

A detailed description of the present invention based on the description of the enclosed drawings is given below:

As shown in FIG. 1 and FIG. 2, the TML multifunctional vibrator-speaker transducer comprises a vibrating diaphragm 1 (or a rigid piece), a voice coil 2 (or vibrating coil relevant to a rigid sheet 1), a resilient plate 3, a pole core 4, a cylindrical magnet 5, a magnetic transfer 6, an annular magnet 7, an annular pole piece 8, a housing 9, a vibrating coil 10 (or voice coil), a rigid sheet 11 (or a vibrating diaphragm relevant to the voice coil 10) etc. The (said) transducer integrates inner and outer magnetic loop of TML into one device and has both vibrating and sound function. The disc-shaped pole core 4, the flange bowl-shaped magnetic transfer 6, the annular pole piece 8, the cylindrical magnet 5 and the annular magnet 7 constitute the inner and outer magnetic loops, wherein the pole core 4 is placed on the cylindrical magnet 8 and centered with the magnetic transfer 6; The annular magnet 7 and the annular pole piece 8 are overlaying each other under the magnetic transfer 6.

The disc-shaped pole core 4, the flange bowl-shaped magnetic transfer 6, the annular pole piece 8, the cylindrical magnet 5 and the annular magnet 7 are connected with the housing 9 via the resilient plate 3 such that either the inner or the outer magnetic loop can be used to produce sound, and the other magnetic loop can be used to provide driving magnetic field for vibrating purposes. The vibrating coil 10 is placed in the air gap, or spacing, of the said magnetic paths for vibrating purposes.

The rigid sheet 11 connects the vibrating coil 10 and is integrated with the supporting housing 9. The voice coil 2 is placed in the air gap, or spacing, of the said magnetic paths for sound purposes and connected with the vibrating diaphragm 1. The said vibrating diaphragm 1 for sound purposes can be polyester film, perm alloy plate or voice diaphragm of other materials.

The inherent resonant frequency of said unit, which is composed of the magnet, the voice coil and the vibrating diaphragm for sound purposes, is kept at a preset value above 400 HZ by adjusting the stiffness coefficient and mass of the vibrating diaphragm as well as the mass of the voice coil. For the unit composed of said vibrating coil 10 for vibrating purposes, the interpolated magnet, the resilient plate 3 and the entire of twin magnetic loops, its inherent resonant frequency are kept at a preset value between 100~200 HZ by adjusting the stiffness coefficient of the resilient plate as well as the overall mass of the twin magnetic loops.

As shown in FIG. 3, FIG. 4, FIG. 5 and FIG. 6, the two magnets 5 and 7 that form the TML in the present invention can be elliptical columns and elliptic rings in shape; then the air gap between them are elliptical rings in shape, and the corresponding voice coil 2, the vibrating coil 10, the pole core 4, the flange magnetic transfer 6, the annular pole piece 8 as well as the resilient plate 3 are also elliptical in shape.

What is claimed is:

1. A twin magnetic loop ("TML") vibrator-speaker multifunctional transducer, comprising:

a bowl-shaped magnetic transfer having a flange (6), having a first top side and a bottom side;

a cylindrical magnet (5);

a disc-shaped pole core (4), said pole core being placed on the cylindrical magnet and centered in the bowl-shaped magnetic transfer on the top side, forming an inner magnetic loop;

an annular pole piece (8);

an annular magnet (7), having an inward surface and an outward surface, said annular magnet overlaying the annular pole piece and being placed on the bottom side of the flange of the bowl-shaped magnetic transfer forming an outer magnetic loop, wherein said inner magnetic loop and outer magnetic loop are integrated, wherein the cylindrical and annular magnets are elliptical column and elliptical ring in shape, a spacing between the magnets is elliptical in shape; and a voice coil, a vibrating coil, the pole core, the magnetic transfer, the annular pole piece and an annular resilient plate are also elliptical in shape;

further comprising:

a housing supporting base (9); and the annular resilient plate (3) connecting the flange at the top side of the bowl-shaped magnetic transfer, wherein said the disc-shaped pole core, the bowl-shaped magnetic transfer, the annular pole piece, the cylindrical magnet and the annular magnet are coupled to the housing supporting base via the annular resilient plate.

2. The TML vibrator-speaker multifunctional transducer of claim 1, wherein said vibrating coil being placed between the bottom side of the bowl-shaped magnetic transfer and the inward surface of the annular magnet;

said transducer further comprising a rigid sheet (11), said rigid sheet being connected to the vibrating coil at the center of the rigid sheet, said rigid sheet joining the supporting support base at the perimeter of the rigid sheet.

3. The TML vibrator-speaker multifunctional transducer of claim 1 , further comprising:

a vibrating diaphragm (1), said voice coil joining said vibrating diaphragm at the center of the vibrating diaphragm, for placing said voice coil into a spacing of the inner magnetic loop so as to produce sound.

4. The TML vibrator-speaker multifunctional transducer of claim 3, wherein the vibrating diaphragm used to emit sound is made of one of a polyester film, and a perm alloy plate.

5. The TML vibrator-speaker multifunctional transducer of claim 3, wherein an inherent resonant frequency of the magnetic loop, the voice coil and the vibrating diaphragm for sound function, is preset a value above 400 HZ.

6. The TML vibrator-speaker multifunctional transducer of claim 2, wherein an inherent resonant frequency of the vibrating coil, the resilient plate and the TML for performing vibrating function, is between 100–200 HZ.

7. A twin magnetic loop ("TML") vibrator-speaker multifunctional transducer, comprising:

a bowl-shaped magnetic transfer having a flange (6), having a first top side and a bottom side;

a cylindrical magnet (5);

a disc-shaped pole core (4), said pole core being placed on the cylindrical magnet and centered in the bowl-shaped magnetic transfer on the top side forming an inner magnetic loop;

an annular magnet (7), having an inward surface and an outward surface, said annular magnet overlaying the annular pole piece and being placed on the bottom side of the flange of the bowl-shaped magnetic transfer, forming an outer magnetic loop, wherein said inner magnetic loop and outer magnetic loop are integrated, wherein:

the magnets are elliptical column and elliptical ring in shape;

a spacing between the magnets is elliptical in shape; and a voice coil, a vibrating coil, the pole core, the magnetic transfer, the annular pole piece and a resilient plate are also elliptical in shape.

8. A twin magnetic loop ("TML") vibrator-speaker multifunctional transducer, comprising:

a bowl-shaped magnetic transfer having a flange (6), having a first top side and a bottom side;

a cylindrical magnet (5);

a disc-shaped pole core (4), said pole core being placed on the cylindrical magnet and centered in the bowl-shaped magnetic transfer on the top side, forming an inner magnetic loop;

an annular pole piece (8);

an annular magnet (7), having an inward surface and an outward surface, said annular magnet overlaying the annular pole piece and being placed on the bottom side of the flange of the bowl-shaped magnetic transfer, forming an outer magnetic loop, wherein said inner magnetic loop and outer magnetic loop are integrated;

a housing supporting base (9);

an annular resilient plate (3) connecting to the flange at the top side of the bowl-shaped magnetic transfer, wherein said the disc-shaped pole core, the bowl-shaped magnetic transfer, the annular pole piece, the cylindrical magnet and the annular magnet are coupled to the housing supporting base via the annular resilient plate;

a voice coil (10), said voice coil being placed between the bottom side of the bowl-shaped magnetic transfer and the inward surface of the annular magnet;

a vibrating diaphragm (11), said vibrating diaphragm being connected to the voice coil at the center of the vibrating diaphragm, said vibrating diaphragm joining the supporting support base at the perimeter of the vibrating diaphragm;

a vibrating coil (2);

a rigid sheet (1), said vibrating coil joining said rigid sheet at the center of the rigid sheet, for placing said vibrating coil into a spacing of the inner magnetic loop so as to produce sound, wherein:

the cylindrical and annular magnets are elliptical column and elliptical ring in shape;

a spacing between the cylindrical and annular magnets is elliptical in shape; and the voice coil, the vibrating coil, the pole core, the magnetic transfer, the annular pole piece and the resilient plate are elliptical in shape.

* * * * *